US006256464B1

(12) United States Patent
Sumiyoshi

(10) Patent No.: US 6,256,464 B1
(45) Date of Patent: Jul. 3, 2001

(54) ELECTROPHOTOGRAPHY APPARATUS

(75) Inventor: Michio Sumiyoshi, Hitachi (JP)

(73) Assignee: Hitachi, LTD, Tokyo (JP)

( * ) Notice: Subject to any disclaimer, the term of this patent is extended or adjusted under 35 U.S.C. 154(b) by 0 days.

(21) Appl. No.: 09/517,591

(22) Filed: Mar. 3, 2000

(30) Foreign Application Priority Data

Mar. 15, 1999 (JP) ..... 11-068997

(51) Int. Cl.[7] ..... G03G 15/00
(52) U.S. Cl. ..... 399/88; 399/364
(58) Field of Search ..... 399/88, 401, 402, 399/364; 358/1.14

(56) References Cited

U.S. PATENT DOCUMENTS 6,072,585 * 6/2000 Dutton et al. ..... 358/1.12
6,134,401 * 10/2000 Yun et al. ..... 399/70

* cited by examiner

*Primary Examiner*—Sophia S. Chen
*Assistant Examiner*—Hoan Tran
(74) *Attorney, Agent, or Firm*—Antonelli, Terry, Stout & Kraus, LLP

(57) ABSTRACT

A unit exclusive use power source is provided for a duplexer printing unit which is coupled to a color printer main body of an electrophotography apparatus. The unit exclusive use power source has a circuit for presenting an "on" state and "off" state of a supply of electric power to respective constituting components in the duplexer printing unit in accordance with an indication of a controlling device. When the color laser printer main body is in an electric power saving mode and when an abrupt duplex printing after release of the electric power saving mode is unnecessary, the controlling device enables an "off" state of the unit exclusive power source. Since an operation of the coupled duplexer printing unit is unnecessary, such as in the electric power saving mode time, the power source of the duplexer printing unit is presented to the "off" state. Thereby, the electrophotography apparatus satisfies electric power regulation value therefor.

5 Claims, 5 Drawing Sheets

ELECTROPHOTOGRAPHY APPARATUS

BACKGROUND OF THE INVENTION

The present invention relates to an electrophotography apparatus such as an electrophotography printer including a laser printer and an electrophotography coping machine etc. and, more particularly, relates to an optional unit construction of an electrophotography apparatus having a transferring device.

In general, in a formation method of a color picture image in an electrophotography apparatus having an intermediate transferring body, an electrostatic latent image on a photoconductive body is developed according to respective developing devices and a developed toner image is transferred once on the intermediate transferring body and on the above that a color overlapping is carried out, after that to a paper sheet which has transported by a transporting device a color toner image on the intermediate transferring body is transferred in the lump and is formed.

As stated in above, in the color electrophotography apparatus having the intermediate transferring body, the toner image on the photoconductive body is transferred once to the intermediate transferring body from the photoconductive body, and further from the intermediate transferring body to the paper sheet two times transfer is carried out and then the picture image is formed. After that according to a fixing device the color toner image on the paper sheet is heated and fixed and the paper sheet is discharged outside of the color electrophotography apparatus.

Further, in a color electrophotography apparatus having a duplexer printing unit which enables duplex printing, it is common that after a first color toner image on a paper sheet surface (A face) is heated and fixed once by the fixing device, this paper sheet is reversed in the duplexer printing unit, and a rear face (B face) of the paper sheet is transported as a next printing face to a transporting device of the color electrophotography apparatus, and in a manner similar to the printing of the A face, the B face is printed.

Further, recently from a consideration of the environment, there is a tendency to provide for energy saving and when a standard for regulating the power saving (for example an energizer: it differs from the devices, for example, under a condition (a sleeping time) in which the device is not operated and provides for consumption electric power which is less than 45 W) is not obtained, then such device is not accepted in a market.

Up to now, in the color electrophotography apparatus, to drive a control device (mainly, a control board), an optical sensor, a display element etc., a voltage power source having 5 V is used, further, to the actuators such as a motor, a fan, a clutch, a solenoid, in a relation of a construction efficiency, a voltage power source of 25 V which is higher than 5 V is used, and in many cases the electrophotography apparatus has these different power sources.

In general, during the electric power saving time, since it is unnecessary to operate the apparatus, all actuators and the heater are presented to an "off" state, the electric power consumption is reduced. Further, a 24 V power source is presented to an "off" state.

However, in the power source having 5 V for driving the controlling device (including CPU), such a 5 V electric power source cannot be presented to an "off" state. However, the components of the sensors, which in many cases are constituted by the above stated 5 V power source, are operated and further nevertheless during the electric power saving mode time it is required to leave the displaying device operational for informing the condition of an operator from aspects to a safety performance and a function performance.

Further, when the duplexer printing unit and a sorting device etc. which are optional units are added to the color electrophotography apparatus which is a main body, it is a rare case in which there is not an increase in the consumption energy having each optional unit part, but it is necessary to obey a regulated electric power saving standard as a system including the optional units.

On the other hand, when with only the color printing to the electrophotography apparatus main body there is afford for opportunities to achieve the electric power saving regulation value, it is devised to improve the consumption electric power reduction of the electrophotography apparatus main body. However, there is a case in which only the optional units themselves consumes much energy, there is a limitation to connect all optional units and to obey the electric power saving standard.

As stated above, in the conventional color electrophotography apparatus, there is a problem in which the electric power saving regulation is not satisfied fully.

SUMMARY OF INVENTION

An object of the present invention to provide an electrophotography apparatus wherein when an operation of an added or coupled duplexer printing unit is unnecessary such as in an electric power saving mode during, an "off" state of a power source of the duplexer printing unit is effected, and a consumption of electric power can be reduced.

Another object of the present invention to provide an electrophotography apparatus wherein when an operation of an added or coupled duplexer printing unit is unnecessary such as an electric power saving mode during, an "off" state of a power source of the duplexer printing unit is effected, and an electric power saving regulation can be satisfied.

To attain the above stated objects according to the present invention, an essential feature according to the present invention resides in that a duplexer printing unit which is added or coupled to an electrophotography apparatus is provided with a unit exclusive use power source device. The unit exclusive use power source has a circuit for presenting an "on" state and an "off" state of a supply of an electric power to respective constituting components of the duplexer printing unit in accordance with an indication of the controlling device.

The present invention provides in an electrophotography apparatus having an electrophotography apparatus main body which comprises a photoconductive body, a developing device for a toner developing an electrostatic latent image which is formed on the photoconductive body, a device for receiving a paper sheet which transfers the toner image, a transporting device for transporting the paper sheet, a transferring device for transferring the toner image on the photoconductive body to the paper sheet, a fixing device for heat fixing the toner image on the paper sheet to the paper sheet, and a controlling device for controlling each device, and a duplexer printing unit coupled to the electrophotography apparatus main body and for reversing the paper sheet in which the toner image is heat fixed and transporting the reversed paper sheet to the transporting device, wherein the duplexer printing unit has a unit exclusive use power source device which has a circuit for presenting an "on" state and an "off" state of a supply of an electric power to the constituting components of the duplexer printing unit in accordance with an indication of the controlling device.

Preferably, when the electrophotography apparatus main body is in an electric power saving mode and after a release of the electric power saving mode, an immediate duplex printing is unnecessary, the controlling device controls a power source of the unit exclusive use power source device to be at the "off" state.

Preferably, the duplexer printing unit has a circuit for selecting the supply of the electric power to specific constituting components in each constituting components whether receiving electric power from the unit exclusive use electric power device or a power source of the electrophotography apparatus main body.

Preferably, when the specific constituting components require the supply of the electric power at ordinary times, the supply of the electric power is received from the power source of the electrophotography apparatus main body.

Preferably, the unit exclusive use power source is constituted so that the "on" state and the "off" state of the supply of the electric power in an AC input section at a primary side.

DESCRIPTION OF THE INVENTION

Figure 1:
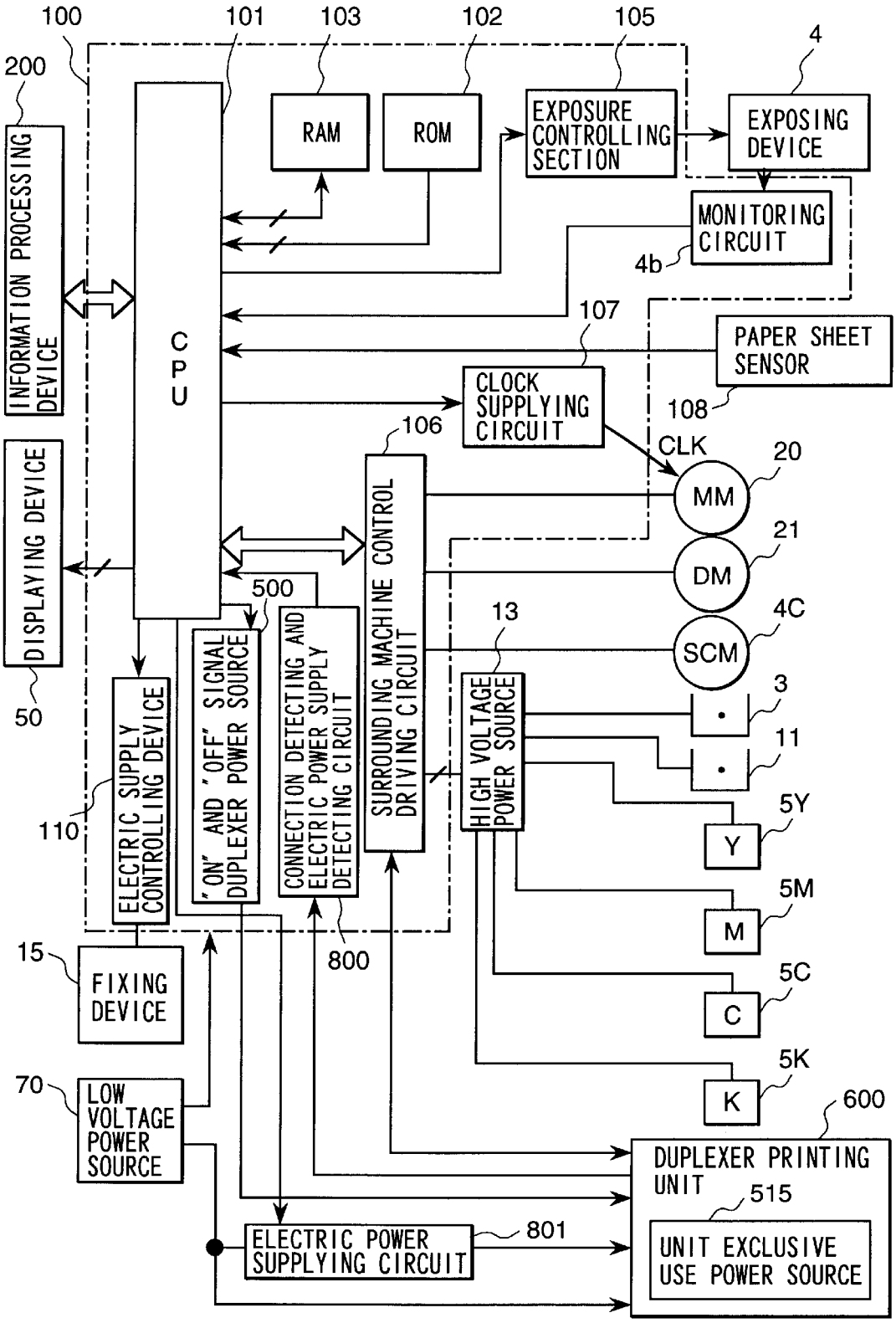
FIG. 1 is a block diagram showing a construction of a laser color printer having a duplexer printing unit of one embodiment according to the present invention.

Hereinafter, an electrophotography apparatus of one embodiment according to the present invention will be explained referring to the drawings.

Figure 6:
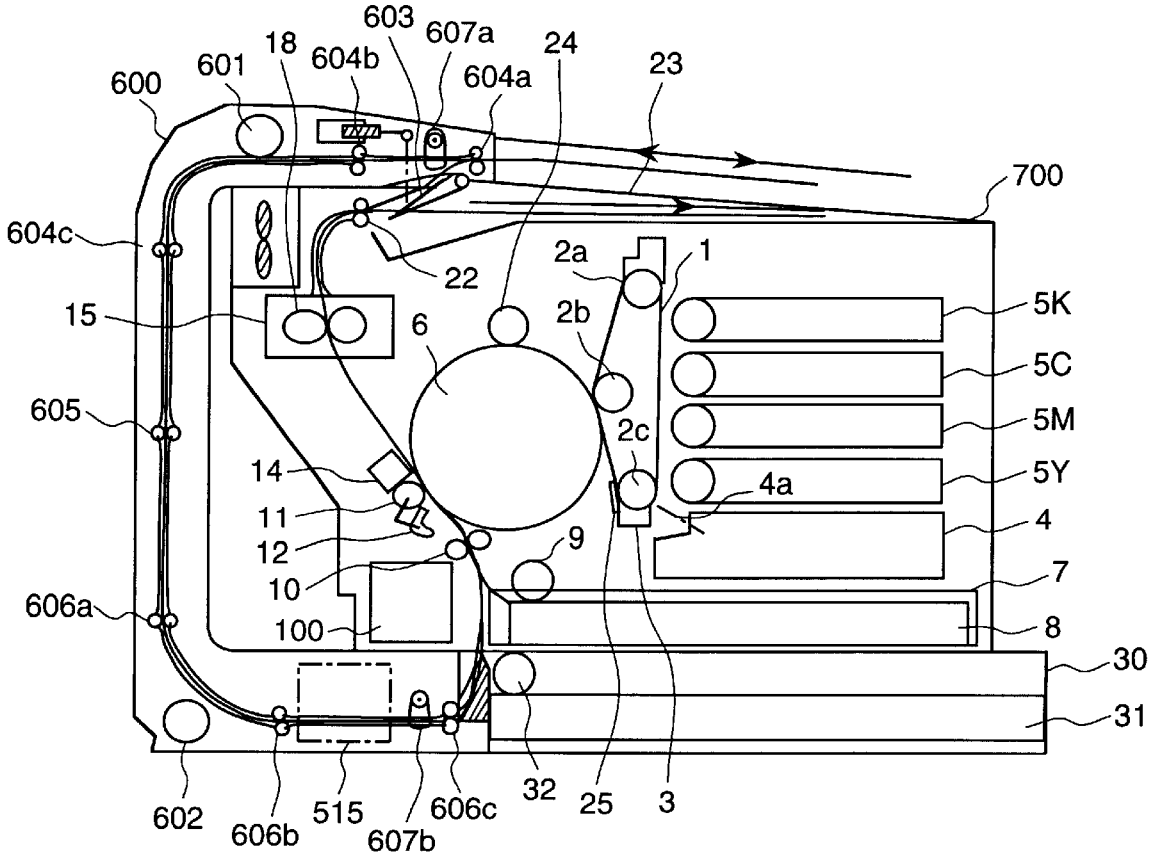
FIG. 6 is a longitudinal cross-sectional side view showing a laser color printer having a duplexer printing unit of another embodiment according to the present invention.

FIG. 6 is a longitudinal cross-sectional side view showing a laser color printer having a duplexer printing unit of one embodiment according to the present invention.

As shown in FIG. 6, a color laser printer having a duplexer printing unit is constituted by a color laser printer main body 700, a paper feeding cassette 30, and a duplexer printing unit 600.

Figure 4:
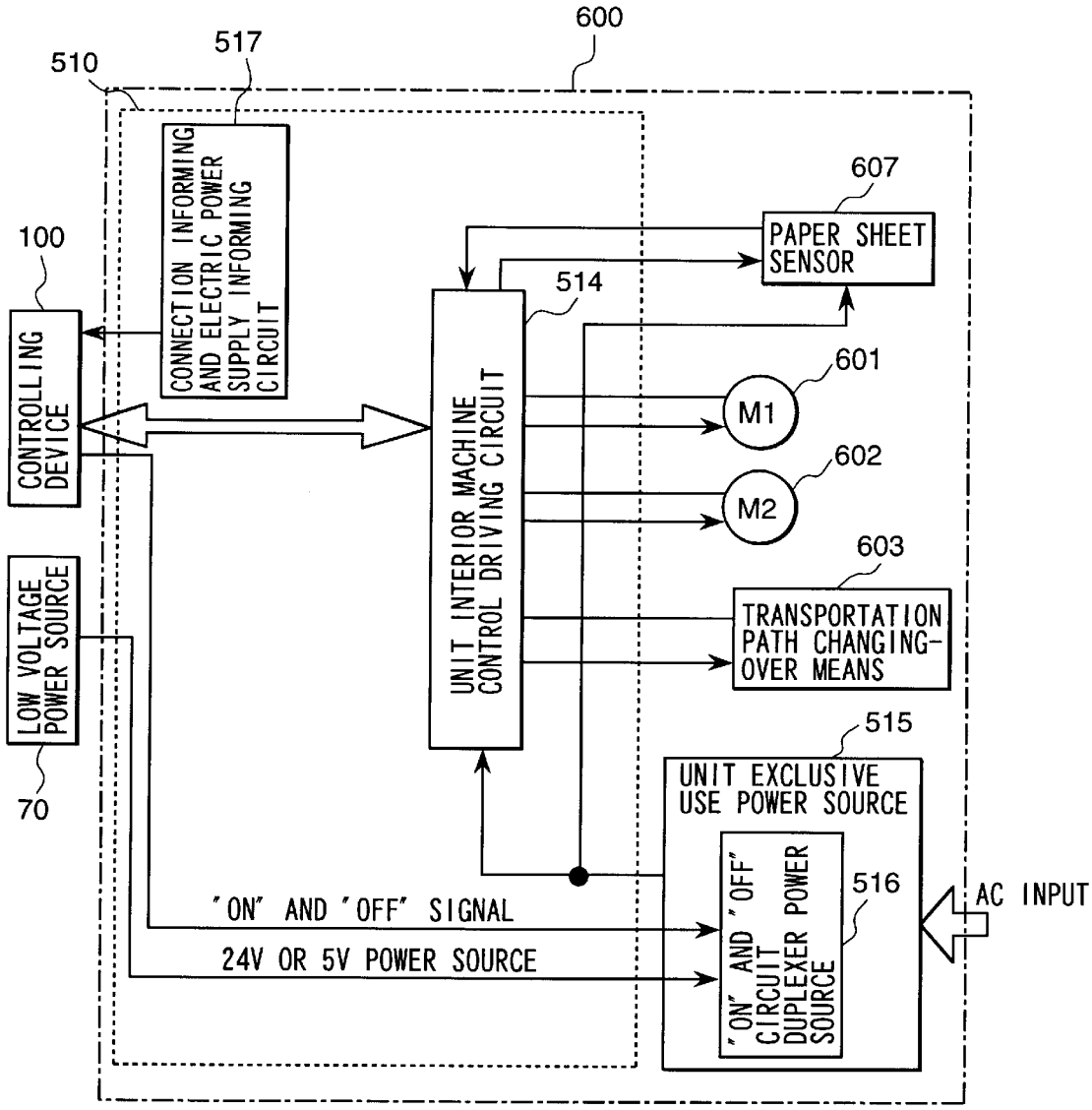
FIG. 4 is a block diagram showing a construction of another embodiment according to the present invention of the unit controlling device of FIG. 2.

Although not described in detail, when a construction of the duplexer printing unit 600 is connected to the color electrophotography apparatus main body 700, there are cases in which the color laser printer main body 700 is not altered and a case in which a part of the color laser printer main body 700 is altered. FIG. 4 shows a construction in which the duplexer printing unit 600 is connected. In particular, a minute connection method is not described with respect to the connection of the color laser printer main body 700 to the duplexer printing unit 600 regardless of the necessity of the addition is defined. Accordingly, herein, as the addition of the duplexer printing unit 600 is exemplified, and hereinafter it will be explained in detail. As another example, the addition may be in the form of an optional unit which is added to the color laser printer main body 700.

First of all, an operation in which printing is carried out to only one side (A face) of a paper sheet 8 without use of the duplexer printing unit 600 according to the present invention will be explained with reference to FIG. 6.

A photoconductive belt 1 which is a photoconductive body is rotated around guide rollers 2*a*, 2*b* and 2*c* with a constant speed and electricity is charged uniformly using an electric charger 3. After that, an electrostatic latent image which corresponds to each color is formed in turn by exposing according to a laser light 4*a* which is generated from an exposing device 4 according to respective color picture image signals. The electrostatic latent image is developed in turn using the respective developers which uses developing agents of the color corresponding to four developing devices 5Y, 5M, 5C and 5K and each color toner image is formed.

Each color toner image on a surface of the photoconductive belt 1 is transferred on a surface of a transferring drum 6, which is an intermediate transferring body and is rotated synchronously by contacting to the surface of the photoconductive belt 1, and the color toner image becomes a color toner image on the surface of the transferring drum 6.

The paper sheet 8, which is a recording medium and is received and accumulated in a first paper cassette 7, is extracted and transported by a paper sheet feed roller 9 and is sent to a resist roller 10. After a transportation timing between the paper sheet order and the color toner image on the surface of the transferring drum 6 is adjusted and controlled, the paper sheet 8 is sent toward a transferring roller 11.

Further, a reference numeral 30 denotes a second paper cassette and in a similar manner, a paper sheet 31 in the second paper cassette 30 is extracted and transported by a second paper roller 32 and is sent to the resist roller 10.

The transferring roller 11 constitutes a part of a transferring device and the transferring roller 11 provides a mechanical pressing force and a transferring electric field from a back face by contacting the paper sheet to the transferring drum 6 and transfers the color toner image formed on the surface of the transferring drum 6 to one side face (A face) of the paper sheet 8.

Further, the transferring roller 11 transfers each color toner image of the photoconductive belt 1 to the surface of the transferring drum 6 and is pulled by a transferring roller transferring device 12 so as to not function during a process for forming the color toner image. Further, the transferring roller 11 is pushed toward the transferring drum 6 so as to function during a process for completing the color toner image and for transfer to the paper sheet 8. A transferring voltage is supplied to the transferring roller 11 so as to generate the transferring voltage is provided by a high voltage power source 13 (not shown).

An AC discharger 14 is a discharging device which enables generation of an alternating current corona and the AC discharger 14 is given a discharge using an alternating current voltage which can alter voluntary and continuously an output voltage by a duty rate of an input signal from the high voltage power source 13 and peels off the paper sheet 8 from the transferring drum 6 by neutralizing and discharging the electric charge which remains in the rear face of the paper sheet 8 to which the color toner image is transferred.

The paper sheet 8 peeled off from the transferring drum 6 is sent to a fixing device 15 which performs a process through which the color image is heat fixed to the surface of the paper sheet 8. The paper sheet 8 to which the color toner image is heat fixed is discharged on a paper output tray 23 through an extruding roller 22.

A belt cleaner 25 cleans the toner which remains on the surface of the photoconductive belt I and a drum cleaner 24 cleans the toner which remains the surface of the transferring drum 6. Further, the drum cleaner 24 transfers repeatedly a single toner image on the surface of the transferring drum 6 and is pulled away so as to not perform a cleaning function during a process for forming the color toner image. After a completed color toner image is transferred to the paper sheet 8 the drum cleaner is pressed against the drum so as to clean the surface of the transferring drum 6.

Further, a controlling device 100 controls the devices in accordance with an input signal from an operating panel 50 (not shown) and an input signal from an information processing device 200.

Next, an operation in which the duplexer printing unit 600 is utilized in which the rear face (the B face) of the paper sheet 8 is printed will be explained.

The duplexer printing unit 600 comprises two drive motors 601 and 602 for transporting the paper sheet 8, a paper transportation path exchange-over device 603 for exchanging over so as to send out the paper sheet 8 which is extruded from the paper extruding roller 22 to the paper output tray 23 or to the duplexer printing unit 600, duplexer printing unit sending rollers 604*a*, 604*b* and 604*c* which are provided with a drive force by the drive motor 601; a duplexer printing unit resist roller 605, sending rollers 606*a*, 606*b* and 606*c* which obtain a drive force from the drive motor 602, and paper sensing devices 607*a* and 607*b* for detecting the sending of the paper sheet 8.

The paper sheet 8 which has sent out from the paper extruding roller 22 of the color laser printer main body 700 is sent out to a side of the sending roller 604*a* according to the transportation path change-over device 603 and a tip end of the paper sheet 8 which has reached the sending roller 604*a* is discharged once to the outside of the device. After a rear end of the paper sheet 8 has passed through the transportation path exchange-over device 603, the drive motor 601 is rotated in a reverse direction and the sending roller 604*a* is rotated in a reverse direction and then the paper sheet 8 is sent into the duplexer printing unit 600.

In this time, the paper sheet 8 is switched back and the rear end of the paper sheet 8 becomes the tip end in the duplexer printing unit 690 and is transported. The paper sensor 607*a* monitors whether the paper sheet 8 is transported to the duplexer printing unit 600 or not. After that, the paper sheet 8 is stopped once in the duplexer printing unit resist roller 605 and after the adjustment of the paper sheet 8 the transportation of the paper sheet 8 is started and is passed through the paper sensor 607*b*, forming this point as a starting point and the sending rollers 606*a*, 606*b* and 606*c* are stopped again after a predetermined time.

After that, the timing to the color laser printer main body 700 is matched and the sending roller 606*a*, 606*b* and 606*c* are rotated, the paper sheet 8 is transported until the resist roller 10 and the rotations of the sending roller 606*a*, 606*b* and 606*c* are stopped. After that, similarly to a method of the printing time of the A face of the former paper sheet 8, the B face of the paper sheet 8 is printed.

FIG. 1 is a block diagram showing the controlling device 100 of the color laser printer having the duplexer printing unit of FIG. 6.

The controlling device 100 is constituted mainly by a CPU 101, a ROM to which controlling programs of the CPU 101 are stored, and a RAM 103 as a work use memory necessary to carry out the controlling programs of the CPU 101.

The CPU 101 communicates to the information processing device 200 such as the operating panel 50 (not shown), a word processor and a personal computer and transmits printing data generated from the above stated information processing device 200 to an exposure controlling section 105. The exposure controlling section 105 generates laser light 4*a* by controlling the exposure device 4.

A mechanism controlling section 106 (a surrounding machine controlling and driving circuit section) is a controlling section for controlling the mechanism groups of the electrophotography process and by controlled by the CPU 101 a drive indicating signal of each motor and a voltage controlling signal for controlling the generation voltage of the high voltage using the power source 13 etc. are outputted.

A clock generating section 107 supplies a drive use clock to a main motor 20 for driving the transferring roller 9 and the fixing device 15, etc . . . A developing motor 21 drives each of the developing devices.

A paper sheet sensing section 103 shows a paper sheet detecting sensor etc. which indicates the transportation condition of the paper sheet 8 and is arranged on the paper sheet transportation path and these signals are inputted to the CPU 101.

A fixing controlling section 110 (an electricity supply controlling circuit) is an electricity supply controlling device for carrying out the electric power supply to an exothermic body 18 which is provided in the fixing device 15.

A low voltage power source 70 is a power source device of the color electrophotography apparatus main body supplies an electric power to the controlling device 100 and to the various kinds of surrounding machine driving components and further supplies a part of the electric power to the duplexer printing unit 600.

A connection detecting and electric power supply detecting circuit 800 detects whether the duplexer printing unit 600 is connected to the color laser printer main body 700 or not and further is a circuit for detecting whether the duplexer printing unit 600 requires the supply of the electric power or not when the duplexer printing unit 600 is connected.

When the duplexer printing unit 600 requires the supply of the electric power, according to an indication from the CPU 101 an electric power supplying circuit 801 is operated, then the electric power is supplied to the duplexer printing unit 600.

A duplexer power source "on" and "off" signal 500 is a signal in which according to the control signal form CPU 101 the power source in the duplexer printing unit 600 is supplied or cut off.

Figure 2:
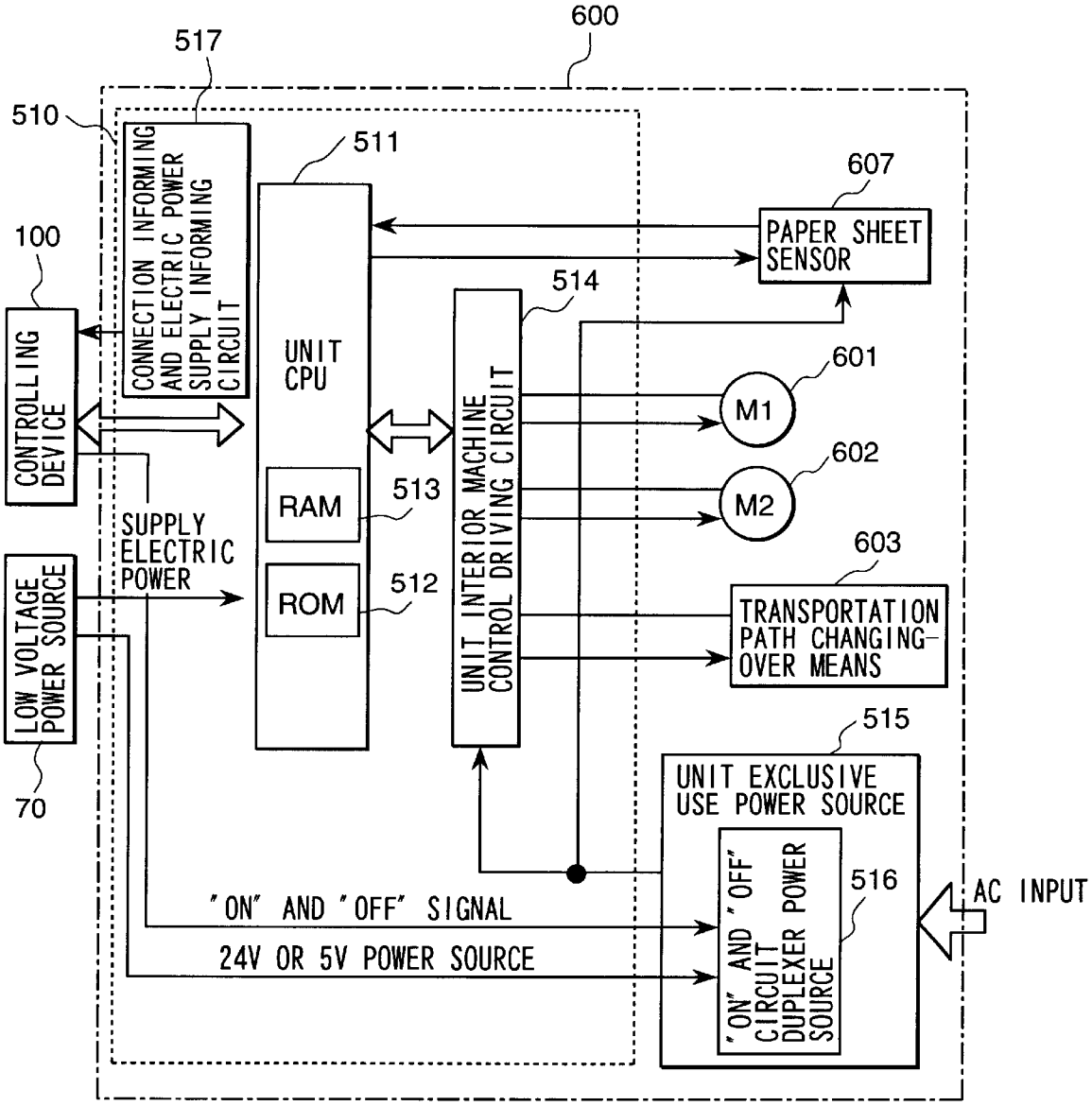
FIG. 2 is a block diagram showing a construction of an unit controlling device which is arranged in the duplexer printing unit of FIG. 1.

FIG. 2 is a block diagram showing a construction of a unit controlling device 510 which is arranged in the duplexer printing unit 600.

The unit controlling device 510 is constituted mainly by constituting components such as an unit interior machine controlling and driving circuit section 514 and the driving motors 601 and 602, a unit CPU 511 which is a specific constituting component being a part of the constituting components, a ROM 512 for storing the controlling programs of the unit CPU 511, and a RAM 513 as a work use memory necessary to perform the controlling programs by the unit CPU 511. However, the RAM 512 and RAM 513 are stored in the unit CPU 511.

The unit CPU 511 communicates with the controlling device 100 and from an inquiry from the controlling device 100, the unit CPU 511 transmits the information of the various kinds of driving devices of the duplexer printing unit 600 and the conditions at that time to the controlling device 100.

As stated in this embodiment according to the present invention, during the electric power saving time when the power source of the unit CPU 511 is presented to the "off" state, it is necessary to perform an initial processing, a re-opening of the communication with the controlling device 100 every time of throw-in of the power source. Further, when the condition information of the duplexer printing unit 600 is held in the RAM 513 provided in the unit CPU 511, the information is lost by presenting the power source to the "off" state. As a result, after the release of the electric power saving, it is possible to carry out immediately the duplexer printing in the duplexer printing unit 600.

When such inconvenience occurs, it is desirable to have the construction in which the power source of the unit CPU 511 is not presented to the off condition. In this embodiment according the present invention, the electric power of the unit CPU 511 is constituted to receive directly the supply from the low voltage power source 70.

The connection informing and electric power supply informing circuit 517 is a circuit in which it informs whether the duplexer printing unit 600 is connected to the controlling device 100 or not and further it informs whether the supply of the electric power is necessary or not. When the electric power is necessary for the unit CPU 511, using this circuit it can inform that the supply of the electric power is necessary.

The controlling device 100 detects the connection condition and the requirement of the electric power supply at a condition from the signal of this circuit, for example in a case of the electric power supplying information: the supply is necessary "L"/ the supply is unnecessary "H".

The unit interior machine controlling and driving circuit 514 is a control section for controlling the drive motors 601 and 602 and the transportation path change-over device 603, etc. and by controlling to the unit control CPU the drive indicating signal of each motors and a signal for controlling the transportation path change-over device 603, etc. are outputted.

A unit exclusive use power source 515 is a power source in which the electric power is supplied to each of the constituting components of the duplexer printing unit 600 such as the unit interior machine controlling and driving circuit section 514 and the driving motors 601 and 602, etc . . .

Figure 3:
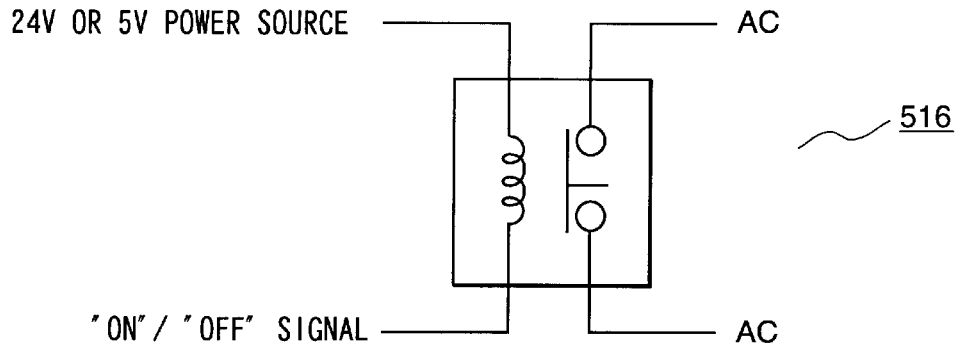
FIG. 3 is a view showing a construction of a duplexer power source which is an "on" and an "off" circuit.

The unit exclusive use power source 515 provides in an interior portion thereof a duplexer power source "on" and "off" circuit 516 which is operated by the electric power supplied from the control signal of the controlling device 100 and the electric power supplied from the low voltage power source 702. Using the duplexer power source "on" and "off" circuit 516, the supply and the cut-off of the AC input is performed. Namely, the unit exclusive use power source 515 is constituted to present to the "on" state and the "off" state of the electric power supply to the unit interior machine controlling and driving circuit 514 and the drive motors 601 and 602 by the indication from the controlling device 100. The duplexer power source "on" and "off" circuit 516, as shown in FIG. 3, for example, is constituted by a relay construction and a coil connected to 24 V power source or 5 V power source which is supplied from the low voltage power source 70 is to present to the "on"/"off" state according to the control signal from the controlling device 100 and then the AC input inputted to the unit exclusive power source 515 is carried out to present the "on" state and the "off" state.

In the above, it explained in detail, in the construction having the unit CPU 511, the unit CPU 511 can not present an "off" state. However, in the construction of the optional unit, when the CPU is made to present an "off" state, since an immediate duplex printing after the electric power saving mode release is unnecessary, it can receive the supply of the electric power from the unit exclusive use power source 515, and further a selection circuit can be operated from the low voltage power source 70 or the unit exclusive use power source 515.

The electric power necessary for driving each of the construction devices in the duplexer printing unit 600 is about 2 W during a stoppage of each driving device, although it may depend on the contents. Under a condition where the duplexer printing unit 600 is used in an ordinary manner in the prior art, against the electric power saving regulation value, when there is a full margin (at least more than 1 W), it becomes a problem and under an unnecessary condition time the duplexer printing unit 600 is presented to the "off" state, it is related to the electric power saving.

In general, when the "off" state and the "on" state of the supply of the electric power is carried out at a secondary side (5 V/24 V generation section) of the power source, even when there is no supply electric power from the secondary side, as a result it can give an impact to the electric power saving regulation value which is desired.

As stated above, with respect to the electric power which is consumed at the secondary side of the power source, the consumption electric power at the primary side has a large loss etc. and further, the more that the consumption electric current value is small, the more that the loss is large and such a loss becomes a value in which the secondary side current value is divided by about 40%–70%. For example, the consumption current value at the secondary side is 24 V/40 mA (a circuit current value of 24 V driving component), 5 V/40 mA (a sensor consumption current), at the AC input part of the power source, about 2.9 W–1.6 W is consumed. It becomes a problem when the margin is small against the electric power saving regulation value in the color laser printer main body 700.

In this embodiment according to the present invention, at the primary side the AC input section of the unit exclusive use power source, since the operations of the supply and the cut-off of the electric power is carried out, even when a minute current generates, the margin against the electric power saving regulation value can be obtained fully and as a result the electric power saving can be carried out.

FIG. 4 shows a construction of another embodiment of the unit controlling device 510 of FIG. 2 according to the present invention. In this embodiment the CPU is not provided in the unit controlling device. Since the CPU is not provided, the connection information and electric power supply information circuit 517 can be set at a condition where the supply of the electric power is unnecessary. (the electric power information: the supply is necessary "L"/ the supply is unnecessary "H").

Accordingly, this embodiment according to the present invention show a case in which all of the electric power supplied to each constituting components are presented to the "off" state.

Figure 5:
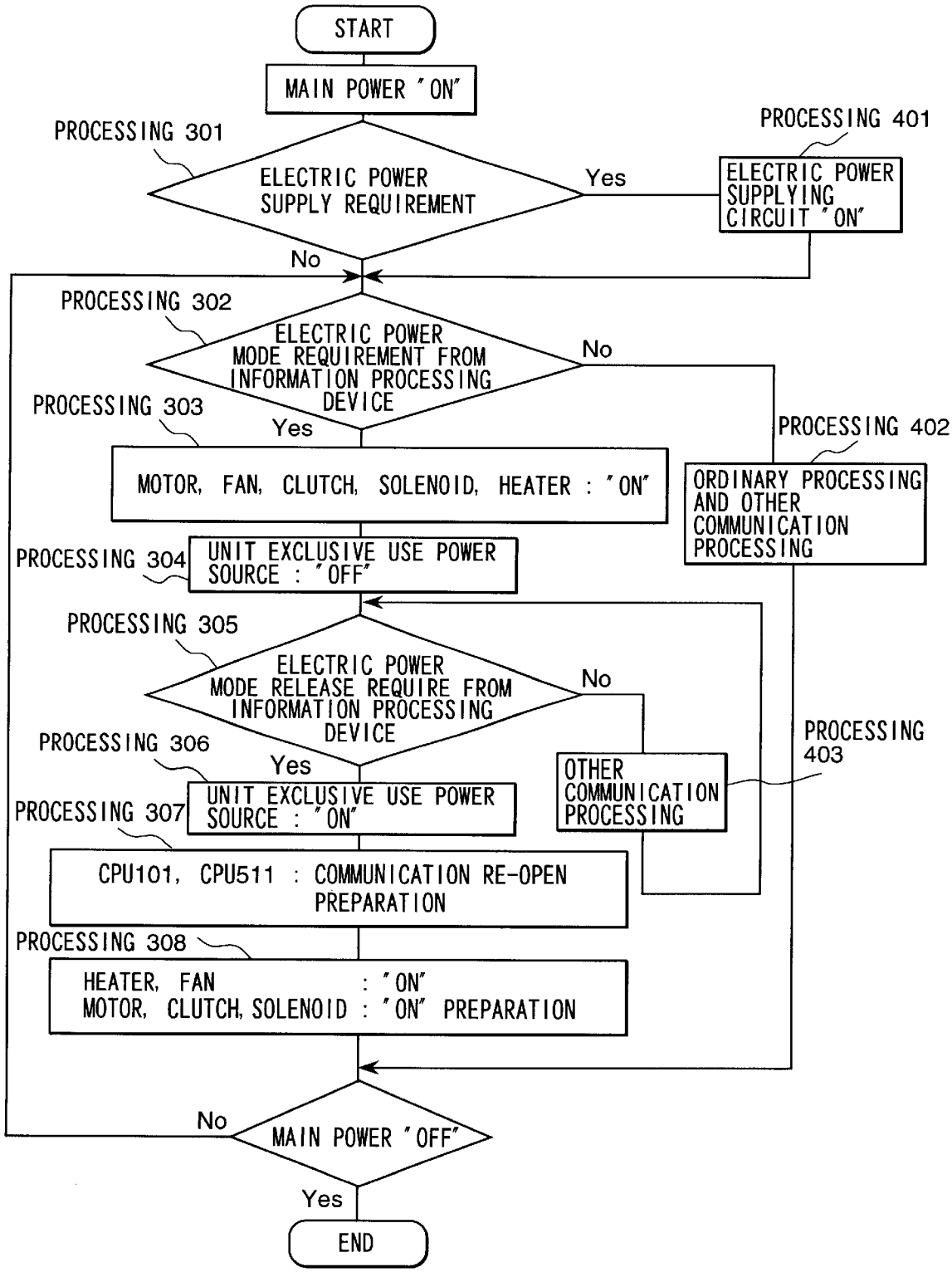
FIG. 5 is a flow chart showing an operation of the control device of FIG. 1.

Next, the operation of the controlling device 100 when the duplexer printing unit 600 is carried out the option-connection will be explained referring to FIG. 5. Herein, the unit CPU 511 is provided in the duplexer printing unit 600.

At first, in a processing 301, the controlling device 100 judges whether the duplexer printing unit 600 requires the supply of the electric power or not. When there is the requirement of the electric power supply, in a processing 401 an electric power supplying circuit 801 is presented to an "on" state.

Ordinarily, the controlling device 100 is formed for its own convenience to the electric power saving mode. However, in many cases, the electric power saving mode becomes according to the requirement from an upper rank information processing device 200.

In a case where there is no requirement, a detailed description is not stated herein, and in a processing 402, an ordinary processing is executed.

When the is the requirement, in a processing 303, the controlling device 100 stops all of the motors, the fan, the clutch, the solenoid, and the heater in the fixing device. After that in a processing 304, the controlling device 100 presents the "off" state of the unit exclusive printing unit 515.

Next, in a processing 305, the judgment whether the release requirement of the electric power saving is from the information processing 200 or not is carried out. When there is no release requirement of the electric power saving, other communication processing is carried out and returns to the processing 305. This is, ordinarily, during the electric power saving the controlling device 100 does not carry out the operation of the printing etc., except for the communication processing operation to the information processing device 200.

In the processing 305, when there is the release requirement, in a processing 306, the controlling device 100 presents the "on" state for the unit exclusive power source 516 of the duplexer printing unit 600.

Next, in a processing 307, in the processing 301 when it judges that the electric power supply is not received, the communication processing starts again in the CPU 101 in the controlling device 100, the unit CPU 511 in the duplexer printing unit 600 and the confirmation of the completion of the "on" preparation of the operation of the duplexer printing unit 600 is carried out.

In the processing 301, when the receiving of the electric power is judged, the communication re-opening processing to the CPU 101 in the controlling device 100 of this processing and the unit CPU 511 in the duplexer printing unit 600 can be skipped.

Successively, in a processing 308, the controlling device 100 is made to present an "on" state for a heater fan of the color laser printer main body 700 and is prepared to present an "on" state for the motor, the clutch, and the solenoid and according to the circumstances they are made to an "on" state.

Herein not explained in detail, after the power source of the duplexer printing unit 600 is presented to the "on" state, in accordance with the indication of the unit CPU 511 in the duplexer printing unit 600, in each constituting components in the duplexer printing unit 600, the operation preparation processing is carried.

In this embodiment according to the present invention, the case of the electric power saving mode is explained in detail, however except for the electric power saving mode condition, as the duplexer printing unit 600 when the operation is an unnecessary condition, the similar operation can be carried out but is not limited to this.

As stated above, the unit exclusive power source 515 for the exclusive use of the duplexer printing unit 600 is constituted as a circuit in which by the control signal from the controlling device 100 the supply and the cut-off of the electric power to the respective constituting components can be selected.

Further a circuit portion of the supply and the cut-off of the electric power is made as a primary side AC input portion, as a result when the function operation of the duplexer printing unit 600 is unnecessary, for example the electric power saving mode time etc., the unit exclusive power source 515 is made to present the "on" state, and the of consumption electric power can be reduced.

Further, the color electrophotography apparatus main body is provided in the electric power saving mode, and when the immediate duplex printing after the electric power saving mode release is unnecessary, against all constituting components of the duplexer printing unit 600 including the unit CPU 511 being the specific constituting component, the power source of the unit exclusive power source 515 is presented to the "off" state, the consumption electric power can be reduced further.

In the above stated embodiment according to the present invention, the duplexer printing unit has a constitution in which with respect to the color electrophotography apparatus main body no alteration is added, for example the user optional unit, is connected. In addition to this, the duplexer printing unit can be constituted in which with respect to the color electrophotography apparatus main body, an alteration in a part thereof is added, and is connected, for example, to the user optional unit.

Further, the duplexer printing unit is not limited to this embodiment according to the present invention, but to the color electrophotography apparatus or the optional constituting components for constituting by adding to the electrophotography apparatus the exclusive use power source can be installed in an interior portion and it is possible to constitute similarly to the above constitution.

According to the present invention, at the electric power saving time, etc., when the function operation is unnecessary,, the exclusive use power source of the duplexer printing unit is made to the "off" state according to the control signal of the controlling device, then the consumption electric power of the whole electrophotography apparatus can be reduced and the electric power saving can be improved.

What is claimed is:

1. In an electrophotography apparatus having an electrophotography apparatus main body which comprises a photoconductive body, a developing device for toner developing an electrostatic latent image which is formed on said photoconductive body, a device for receiving a paper sheet which transfers said toner image, a transporting device for transporting said paper sheet, a transferring device for transferring said toner image on said photoconductive body to said paper sheet, a fixing device for heat fixing said toner image on said paper sheet to said paper sheet, and a controlling device for controlling each of the devices; and a duplexer printing unit coupled to said electrophotography apparatus main body which reverses said paper sheet in which said toner image is heat fixed and transports said paper sheet to said transporting device; wherein said duplexer printing unit including a unit exclusive use power source device which has a circuit for presenting an "on" state and an "off" state of a supply of electric power to respective components of said duplexer printing unit in accordance with an indication of said controlling device.

2. An electrophotography apparatus according to claim 1, wherein when said electrophotography apparatus main body is an electric power saving mode, and after a release of said electric power saving mode, an immediate duplex printing by said duplexer printing unit is unnecessary, said controlling device controls a power source of said unit exclusive use power source device to be at the "off" state.

3. An electrophotography apparatus according to claim 1, wherein said duplexer printing unit includes a circuit for selecting supply of the electric power to predetermined parts in the respective components of said duplexer printing unit whether receiving electric power from said unit exclusive use electric power device or a power source of said electrophotography apparatus main body.

4. An electrophotography apparatus according to claim 3, wherein when said predetermined parts require supply of the electric power at ordinary times, said supply of the electric power is received from said power source of said electrophotography apparatus main body.

5. An electrophotography apparatus according to claim 1, wherein said unit exclusive use power source enables said "on" state and said "off" state of said supply of said electric power in an AC input section at a primary side.

* * * * *